United States Patent [19]

Abedi-Asl

[11] Patent Number: 5,071,455

[45] Date of Patent: Dec. 10, 1991

[54] AIR CLEANER INSTALLATION

[75] Inventor: Behzad Abedi-Asl, Charlotte, N.C.

[73] Assignee: Carrier Corporation, Syracuse, N.Y.

[21] Appl. No.: 535,695

[22] Filed: Jun. 11, 1990

[51] Int. Cl.[5] ..... B03C 3/00

[52] U.S. Cl. ..... 55/1.39; 55/143; 55/145; 55/509; 126/110 R; 29/163.8

[58] Field of Search ..... 55/124, 126, 267, 139, 55/143, 145, 481, 504, 508, 509, DIG. 31; 126/110 R; 29/163.8

[56] References Cited

U.S. PATENT DOCUMENTS

| | | | |
|---|---|---|---|
| 2,473,006 | 6/1949 | Campbell et al. | 55/DIG. 31 |
| 2,564,775 | 8/1951 | Besser | 126/110 R |
| 3,250,063 | 5/1966 | Andrews | 55/484 |
| 3,504,482 | 4/1970 | Goettl | 55/139 |
| 3,626,668 | 12/1971 | Cardiff | 55/126 |
| 3,630,000 | 12/1971 | Mullings | 55/139 |
| 3,654,747 | 4/1972 | Remick | 55/126 |
| 3,782,082 | 1/1974 | Smith et al. | 55/484 |
| 4,290,788 | 9/1981 | Pittman et al. | 55/143 |
| 4,701,196 | 10/1987 | Delany | 55/504 |

*Primary Examiner*—Bernard Nozick

[57] ABSTRACT

An electrostatic air cleaner is attached to a side of a furnace in such a manner as to be positioned and supported during the installation process, and easily connected to the electrical power within the unit. A bracket is attached to the air cleaner frame in such a way as to have an extended lip portion engaged with one edge of the cabinet opening to thereby position and support the air cleaner during the installation process. The power lead is so positioned on the air cleaner frame that, when the air cleaner is placed in position against the unit side wall opening, the lead will project through the side wall opening for connection to a power supply within the unit.

11 Claims, 1 Drawing Sheet

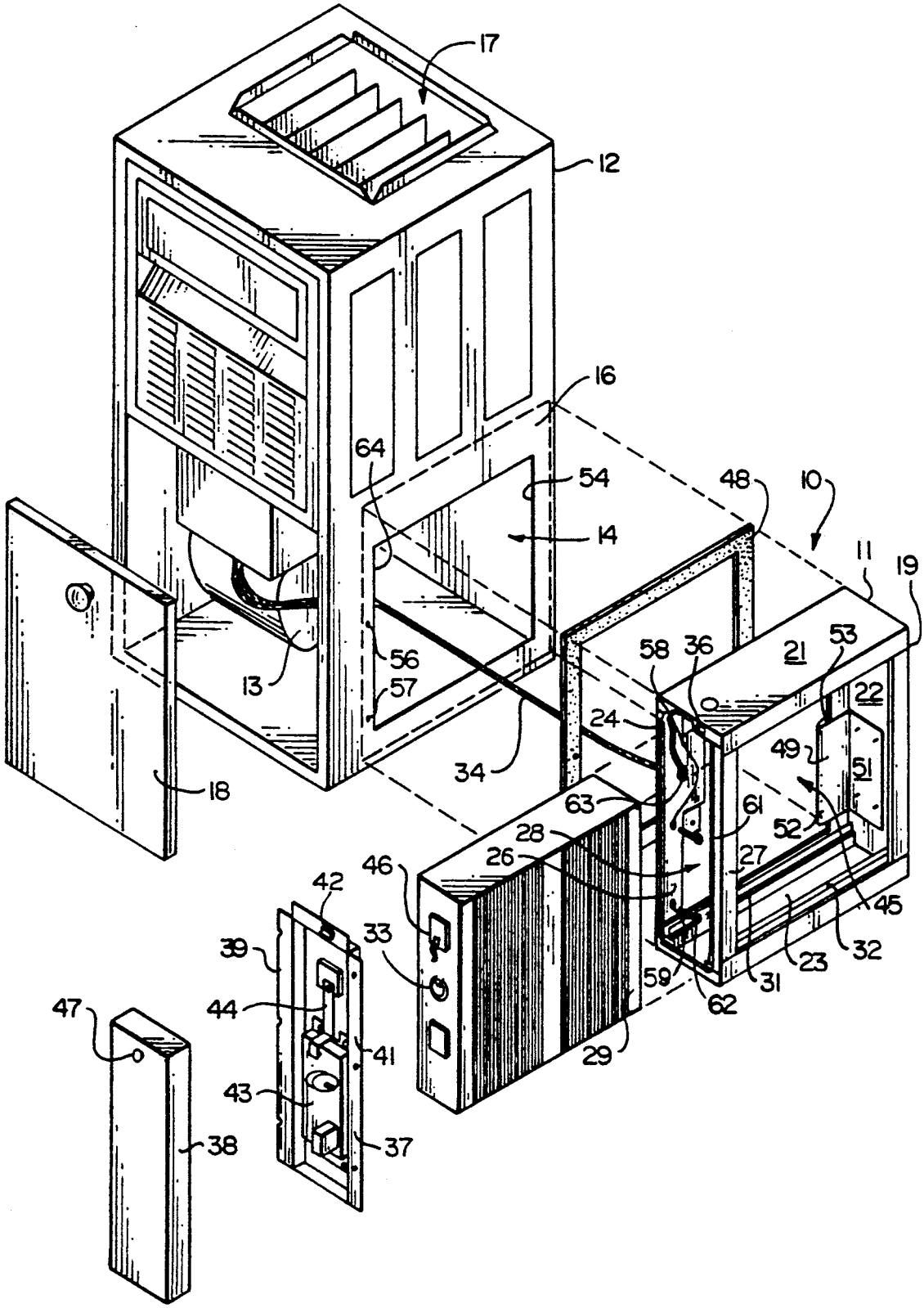
17
12
16
64
54
48
10
14
11
19
56
57
13
58
36
21
53
22
24
49
51
34
18
63
61
52
28
26
27
46
42
45
33
39
32
23
31
59
62
47
44
41
29
43
38
37

AIR CLEANER INSTALLATION

BACKGROUND OF THE INVENTION

This invention relates generally to electrostatic air cleaners and, more particularly to a method and apparatus for installing an electrostatic air cleaner in a residential furnace or air conditioning unit.

It is common to incorporate an electrostatic air cleaner in the return air duct of a blower unit such as one associated with a furnace or an air conditioning system. The air cleaner is a self-contained product that can be installed as part of a new installation or as an accessory to an existing system. In either case, it is customary to mount the air cleaner to the unit at the location where the return air duct comes into the air distribution blower compartment.

Heretofore, it has been common to mount the air cleaner to the unit by the drilling of holes in both the air cleaner framework and in the unit cabinet, and then, while holding the air cleaner up alongside the cabinet wall, inserting fasteners through the aligned holes. It has thus been necessary to provide positive placement, and vertical support for the air cleaner unit while it was being mounted and therefore, a difficult task for an installer working by himself.

Such an electrostatic air cleaner requires electrical power which is commonly obtained from within the unit cabinet. This is accomplished by having the air cleaner coil slideably placed into the air cleaner frame in such a manner as to be "plugged in", and then a power lead which has been wired into the framework, is connected to the power source within the unit cabinet. Since the power lead was attached to the air cleaner framework, which in turn was adapted for fitting against the cabinet wall, it was necessary to drill or otherwise form a hole through the cabinet wall in order to facilitate the insertion of the power lead into the unit cabinet.

It is therefore an object of the present invention to provide an improved method and apparatus for installing an air cleaner unit in a furnace/air conditioning system.

Yet another object of the present invention is the provision for mounting an electrostatic air cleaner to a blower unit without the installer having to provide vertical support therefor during the installation process.

Still another object of the present invention is the provision for electrically connecting an electrostatic air cleaner to a unit without having to form a special hole in the cabinet wall for that purpose.

Still another object of the present invention is the provision for mounting an electrostatic air cleaner to a unit in an economical, efficient and effective manner.

These objects and other features and advantages become more readily apparent upon reference to the following description when taken in conjunction with the appended drawings.

SUMMARY OF THE INVENTION

Briefly, in accordance with one aspect of the invention, the air cleaner unit has a flanged bracket attached thereto which, when the air cleaner unit is placed around the opening of the blower housing or cabinet, is engagable with an edge of the cabinet opening to thereby provide for positive placement of the air cleaner unit while the opposite side of the air cleaner unit is secured to the furnace cabinet by a fastener or the like. In one form, the bracket member is "J" shaped in form, with its upper portion being attached to a vertical wall of the air cleaner unit and its lower lip portion being engagable over the cabinet opening edge for vertical support.

By yet another aspect of the invention, power is provided to the electrostatic coil element of the air cleaner unit by way of electrical power leads that emerge from the air cleaner frame at a point that is located within the unit cabinet side opening such that it is not necessary to form a special opening in the cabinet side wall for that purpose.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

The FIGURE shows an exploded view of an air cleaner unit as installed in accordance with the present invention.

DESCRIPTION OF THE PREFERRED EMBODIMENTS

Referring now to the FIGURE, the invention is shown generally at 10 as it pertains to an air cleaner unit 11 which is installed on one side of a furnace 12 for the purpose of cleaning the air that is circulated back to the furnace 12 by way of a return air duct (not shown). Alternatively, it may be installed in the return air duct of an air conditioning or heat pump system.

The furnace 12 is of a conventional type with burners that heat a plurality of heat exchangers in the upper portion thereof, and having an air circulation blower 13 in a lower compartment for drawing air in through a side opening 14 of the cabinet side wall 16, and then forcing it upwardly across the heat exchangers to be heated and then delivered out the discharge opening 17 at the top of the furnace 12 for distribution throughout the house. A lower front cover 18 is shown in its removed position simply to expose the blower 13 for purposes of this description.

The air cleaner unit 11 includes a rectangular frame 19 having upper, rear, lower and front side members, 21, 22, 23 and 24, respectively. The top 21, rear 22 and bottom 23 members are plate like members made from sheet metal, whereas the front member 24 comprises a pair of vertical frame members 26 and 27 defining an opening 28 therebetween for facilitating the easy insertion and removal of the electrostatic coil unit 29 into the frame 19. The coil unit 29 is adapted to rest on and be supported by spaced rails 31 and 32, which also allow for easy slide-in insertion of the coil unit 29. A ring 33 is mounted on the front side of the coil unit 29 for facilitating the easy removable from the frame 19.

Electrical power to the coil unit 29 is supplied from a power box within the furnace 12 by way of electrical power leads 34 that extend to the frame 19 in a manner to be described more fully hereinafter. The power leads 34 supply electrical power to a female receptacle 36 at the top front of the frame 19. Power is then further transmitted, and transformed to higher voltage by way of a power transformer panel 37 contained in a cover 38. The power transformer panel 37 is mounted in the cover 38 by a pair of side flanges 39 and 41, and the cover 38 and its included transformer panel 37 is then attached to the front frame panel 24 in such a way as to provide high voltage power to the electrostatic coil unit 29. This is accomplished by the transformer panel member 37 as it interfaces between the front panel 24 and the electrostatic coil unit 29.

The power transformer panel 37 has at its top a male plug member 42 which plugs into the female member 36 when the cover 38 is placed into position. The power is then carried by a wire (not shown) to a transformer 43 where the voltage is stepped up to a 8000 volts. That higher voltage power is then transmitted upwardly by way of a contactor 44 which makes contact with a terminal spring 46 on the front of the coil unit 29. In this way, high voltage power is provided to the coil unit 29 when the cover 38 is placed in position, but is disconnected when the cover 38 is removed. The cover 38 is secured in place by a threaded knob 47.

Referring now to the manner in which the air cleaner unit 11 is attached to the furnace 12, it will be seen that the frame 19 is sized such that its central opening 45, through which the return air passes after it has been cleaned by the coil unit 29, is slightly smaller than the side opening 14 in the cabinet side wall 16. The frame 19, however, overlaps a portion of the cabinet side wall structure 16 surrounding the side opening 14. In order to ensure a tight, leak proof interface between the frame 19 and the cabinet side wall 16, a gasket member 48 is placed on the back side of the frame 19 for that purpose. This ensures that the blower 13 draws in air only from the return duct and not from the area around the furnace.

Attached to the rear side panel 22 of the frame 19 is a "J" shaped bracket 49 with its planar upper member 51 rigidly attached to the inner side of the rear panel member 22 such that its depending portion 52 extends inwardly toward the opening 45 and then turns outwardly such that its exposed lip 53 is engagable over the rear edge 54 of the cabinet side opening 14 when the air cleaner unit 11 is placed against the furnace cabinet side wall 16. In this way, the bracket 49 functions to properly locate the rear portion of the air cleaner unit with respect to the side opening 14 and to then hold it in place while the installer secures the air cleaner unit 11 in place by fasteners on the other side thereof. For that purpose a pair of holes 56 and 57 would have been previously formed in the cabinet side wall 16 by way of a template or the like. Similarly, a pair of holes 58 and 59 would have been earlier formed (e.g. at the factory) in the vertical frame member 26. A pair of fasteners 61 and 62 are then inserted into the respective holes in order to secure the frame 19 into its installed position.

Referring now to the electrical leads 34 which are connected to the female receptacle 36 and are then available for connection to a power supply within the furnace, it is desirable that a special hole not have to be made in the cabinet side wall 16 for insertion into the cabinet. Accordingly, the leads pass through the vertical frame member 26 at a hole 63 in vertical frame member 26, which is located at a point inside the edge 64 of the side opening 14, such that they can pass directly to the power supply by way of the side opening 14 rather than by a separate opening. Thus, the vertical frame member 26 and its penetration opening 63 are so positioned that when the air cleaner unit 11 is placed in its final position, the vertical frame member 26 overlaps a portion of the cabinet side wall 16 so as to allow the fasteners 61 and 62 to be placed into proper position, but at the same time allowing the leads to pass through the opening 63 and directly into the side opening 14 so that they can be connected to a power source within the furnace 12.

While the present invention has been disclosed with a particular reference to a preferred embodiment, the concepts of the invention are readily adaptable to other embodiments and those skilled in the art may vary the structure thereof without departing from the true spirit of the present invention.

What is claimed is:

1. An improved method of installing in a cabinet, an air cleaner unit having electrostatic cleaner element and a frame for containing the electrostatic cleaner element and for defining the outer boundaries of a return air flow passage through said cleaner element, comprising the steps of:

forming an opening in one side of the cabinet of the size and shape that are substantially the same as those of the frame defined return air flow passage;

attaching to the frame near one edge thereof, a bracket which extends outwardly to expose an edge facing away from the flow passage;

placing the air cleaner unit against said cabinet one side such that the return air flow passage substantially registers with the cabinet opening, while engaging said bracket over and behind one edge of the cabinet opening; and securing the unit to the cabinet on the side opposite said one edge to thereby hold it in its installed position.

2. A method as set forth in claim 1 wherein the unit is secured to the cabinet by fasteners passing through the unit frame and into the cabinet.

3. An improved method as set forth in claim 1 wherein said frame includes a power lead opening in the side that is placed against the cabinet and said lead opening is so located that when the frame is so placed, said lead opening registers with said cabinet opening, such that said power lead can e extended through said lead opening and said cabinet opening to a power supply in the furnace.

4. A method as set forth in claim 1 wherein the frame includes a vertical side wall and said bracket is attached to said vertical side wall.

5. An improved method as set forth in claim 4 wherein said bracket provided is a "J" shaped bracket with a first element being attached to said vertical side wall and a second element being engaged with said cabinet opening edge.

6. An improved air cleaner unit that is mountable against a furnace wall and has an electrostatic cleaner element and a frame for containing the electrostatic cleaner element within a return air flow passage coincident with an opening in the furnace wall comprising:

a bracket attached to said frame and extending outwardly with an exposed edge facing away from the air flow passage, such that when the air cleaner unit is placed against said furnace wall with its return air flow passage substantially registering with the cabinet opening, a lip portion of said bracket engages one edge of the cabinet opening to thereby position and hold the air cleaner in place; and means for attaching the unit to the cabinet on the side opposite said one edge to thereby secure it in its installed position.

7. An air cleaner as set forth in claim 6 wherein the unit is secured to the furnace wall by fasteners passing through the unit frame and into the furnace wall.

8. An air cleaner as set forth in claim 6 wherein said frame includes a power lead opening in the side that is placed against the furnace wall and said lead opening is so located that when the frame is so placed, said lead opening registers with said furnace wall opening, such that the power lead can be extended from the electrostatic cleaner element, through said lead opening and said furnace wall openings, to a power supply in the furnace.

9. An air cleaner as set forth in claim 6 wherein the frame includes a vertical side wall and said bracket is attached thereto.

10. An air cleaner as set forth in claim 9 wherein said flange member provided is a "J" shaped bracket with one element being attached to said side wall and a second element being engaged with said furnace wall opening edge.

11. An improved air cleaner unit that is mountable around a furnace wall opening and has an electrostatic cleaner element and a frame for containing the electrostatic cleaner element and for providing electrical power to the cleaner element wherein the improvement comprises:

means for transmitting power from the frame to the electrostatic cleaner element;

a power lead with its one end electrically connected within the frame and with its other end being free for connection to a power source within the frame;

the frame having front and rear faces, said front face being adapted to be placed against the furnace wall; and a power lead opening formed in said frame front face, said lead opening being so located that when the frame is placed around the furnace wall opening, said lead opening communicates with said furnace wall opening, such that said power lead can be extended through said lead opening and said cabinet opening, to a power supply in the furnace.

* * * * *